US010309352B2

(12) United States Patent
Yamaguchi

(10) Patent No.: US 10,309,352 B2
(45) Date of Patent: Jun. 4, 2019

(54) INTAKE MANIFOLD

(71) Applicant: TOYOTA BOSHOKU KABUSHIKI KAISHA, Aichi-ken (JP)

(72) Inventor: Takuma Yamaguchi, Aichi-ken (JP)

(73) Assignee: TOYOTA BOSHOKU KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 15/946,815

(22) Filed: Apr. 6, 2018

(65) Prior Publication Data

US 2018/0313305 A1 Nov. 1, 2018

(30) Foreign Application Priority Data

Apr. 28, 2017 (JP) ..... 2017-090666

(51) Int. Cl.
*F02M 35/104* (2006.01)
*F02M 35/10* (2006.01)

(52) U.S. Cl.
CPC ..... *F02M 35/1036* (2013.01); *F02M 35/104* (2013.01); *F02M 35/10321* (2013.01)

(58) Field of Classification Search
CPC ..... F02M 35/1036; F02M 35/10321; F02M 35/104; F02M 35/10354; F02M 35/1034
See application file for complete search history.

(56) References Cited

U.S. PATENT DOCUMENTS

2014/0338627 A1 11/2014 Yamaguchi
2014/0352642 A1* 12/2014 Kilby ..... F02F 7/006 123/184.21
2016/0341160 A1* 11/2016 Dominic ..... F02M 35/1034
2017/0074219 A1* 3/2017 Nola ..... F02M 35/104
2017/0175688 A1* 6/2017 Nola ..... F02M 35/10242
2017/0306909 A1* 10/2017 Tanaka ..... B60K 15/01
2018/0045147 A1* 2/2018 Morimoto ..... F02M 26/01

FOREIGN PATENT DOCUMENTS

JP 2012-197702 10/2012
JP 2014-224480 12/2014

* cited by examiner

*Primary Examiner* — Jacob M Amick
(74) *Attorney, Agent, or Firm* — Greenblum & Bernstein, P.L.C.

(57) ABSTRACT

An intake manifold includes a plurality of intake pipes that are provided in line to send air to an engine mounted on a vehicle through the intake pipes. Each of the intake pipes includes a main body formed of resin and an end pipe formed of resin, welded to a lower stream end side of the main body, and joined to the engine. Further, one member of the main body and the end pipe is provided with a rib that is formed on a side surface portion of the one member and that extends toward a lateral side of the other member. The other member is provided with a restriction portion that is formed on a side surface portion of the other member and that interferes with the rib to restrict moving of the main body in the crash direction relative to the end pipe when a weld portion of the main body and the end pipe is broken due to a collision load applied to the intake pipe at a vehicle crash.

7 Claims, 7 Drawing Sheets

INTAKE MANIFOLD

CROSS-REFERENCE TO RELATED APPLICATIONS

The present application claims priority under 35 U.S.C. § 119 of Japanese Application No. 2017-090666 filed on Apr. 28, 2017, the disclosure of which is expressly incorporated by reference herein in its entirety.

BACKGROUND

1. Technical Field

The present invention relates to an intake manifold, and more particularly to an intake manifold including a plurality of intake pipes which are provided in line.

2. Related Art

A conventional intake manifold including a plurality of intake pipes which are provided in line so as to send air to an engine mounted on a vehicle through the intake pipes has been generally known (refer to, for example, Patent Literature 1; JP 2014-224480 A). The intake manifold disclosed in Patent Literature 1 includes the intake pipes each of which is provided with a main body formed of resin and an end pipe formed of resin, welded to a lower stream end side of the main body, and joined to the engine. Further, each of the end pipes includes a control valve for controlling a volume of air flow.

According to the above structure, when a weld portion of the main body and the end pipe is broken and separated due to a collision load applied to the intake pipe at a vehicle crash, the main body moves relative to the end pipe joined to the engine, so that peripheral parts (for example, a fuel hose) may be damaged by a weld fracture surface of the main body. As a measure against that, a structure to reinforce an outer periphery side of the weld portion of the main body and the end pipe by a metal holder is suggested. According to this measure, although there is no problem in terms of strength, weight and cost of the intake manifold are increased due to addition of parts. As another measure against that, the main body and the end pipe may be molded in one piece so as not to form the weld portion instead of forming the main body and the end pipe separately. According to this measure, installation accuracy of, for example, a control valve which is provided in each of the end pipes is decreased. Further, because a shape of each of the intake pipes must be specialized, a complex construction of a metal mold with, for example, a rotational core is required, which may result in an increase of manufacturing cost.

Incidentally, in a technique disclosed in Patent Literature 2 (JP 2012-197702 A), an intake manifold includes a weld portion which is provided at an upper stream side of an intake pipe and whose direction is parallel to a load application direction in order to restrain the intake manifold from harming a fuel system at the vehicle crash. However, the technique disclosed in Patent Literature 2 is not applied to the intake manifold presupposing that the weld portion is provided at a lower stream side of each of the intake pipes.

SUMMARY

Embodiments of the present invention have been devised in view of the circumstances described above. An object of the embodiments of the present invention is to provide an intake manifold that restrains harm to peripheral parts at a vehicle crash and that has a lightweight and inexpensive structure.

One aspect of the present embodiments provides an intake manifold comprising a plurality of intake pipes that are provided in line to send air to an engine mounted on a vehicle through the intake pipes, each of the intake pipes including: a main body formed of resin; and an end pipe formed of resin, welded to a lower stream end side of the main body, and joined to the engine, wherein one member of the main body and the end pipe is provided with a rib that is formed on a side surface portion of the one member and that extends toward a lateral side of the other member, and the other member is provided with a restriction portion that is formed on a side surface portion of the other member and that interferes with the rib to restrict moving of the main body in a crash direction relative to the end pipe when a weld portion of the main body and the end pipe is broken due to a collision load applied to each intake pipe at a vehicle crash.

In a further aspect, the one member may be the main body, and the other member may be the end pipe.

In a further aspect, the rib may contain: a pair of vertical ribs each of which extends from the side surface portion of the lower stream end side of each of the main bodies of a pair of the intake pipes that are adjacent to each other toward the lateral side of the end pipe; and a connection rib that connects the pair of vertical ribs to each other, and the vertical rib may be arranged to be opposite to or in contact with the restriction portion in the crash direction.

In a further aspect, the connection rib may be welded to a side of the end pipe.

In a further aspect, the end pipe may include a control valve configured to control a volume of air flow.

In a further aspect, an alignment direction of the intake pipes may correspond to a longitudinal direction of the vehicle.

In a further aspect, flanges may be provided on an axial end side of the main body and an axial end side of the end pipe so as to be welded to each other, the rib may be integrally formed on a side surface portion of the flange of the one member, and the restriction portion may be integrally formed on a side surface portion of the flange of the other member.

According to an intake manifold of the embodiments, each of intake pipes includes a main body formed of resin and an end pipe formed of resin, welded to a lower stream end side of the main body, and joined to an engine. In each of the intake pipes, one member of the main body and the end pipe is provided with a rib that is formed on a side surface portion of the one member and that extends toward a lateral side of the other member. The other member is provided with a restriction portion that is formed on a side surface portion of the other member and that interferes with the rib to restrict moving of the main body in the crash direction relative to the end pipe when a weld portion of the main body and the end pipe is broken due to a collision load applied to the intake pipe at a vehicle crash. Therefore, since the rib and the restriction portion interfere with each other at the vehicle crash, the main body is restricted from moving in the crash direction relative to the end pipe that is joined to the engine. Hence, a weld fracture surface of the main body is hard to be exposed to restrain harm which the weld fracture surface applies to peripheral parts. Further, the intake manifold has a structure which is more lightweight and inexpensive than that of the conventional intake manifold including a metal holder.

In a case where the one member is the main body and the other member is the end pipe, the rib and the restriction portion are easily provided on the intake pipe.

In a case where each of the ribs contains a pair of vertical ribs and a connection rib, and the vertical rib is arranged to be opposite to or in contact with the restriction portion in the crash direction, the vertical rib and the restriction portion interfere with each other. Therefore, the main body is restricted from moving in the crash direction relative to the end pipe. Because each of the ribs is provided to be put across the main bodies of a pair of the intake pipes that are adjacent to each other, strength of the pair of intake pipes is increased.

In a case where the connection rib is welded to a side of the end pipe, weld strength of the main body and the end pipe is increased.

In a case where each of the end pipes includes a control valve configured to control a volume of air flow, installation accuracy of the control valve is increased.

In a case where the intake pipes are arranged along a longitudinal direction of the vehicle, the main body is restricted from moving in the crash direction relative to the end pipe at the vehicle crash from the front side.

In a case where flanges are provided on an axial end side of the main body and an axial end side of the end pipe so that the rib is integrally formed on a side surface portion of the flange of the one member and the restriction portion is integrally formed on a side surface portion of the flange of the other member, the rib and the restriction portion are easily provided on the intake pipe.

BRIEF DESCRIPTION OF DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION

Figure 1:
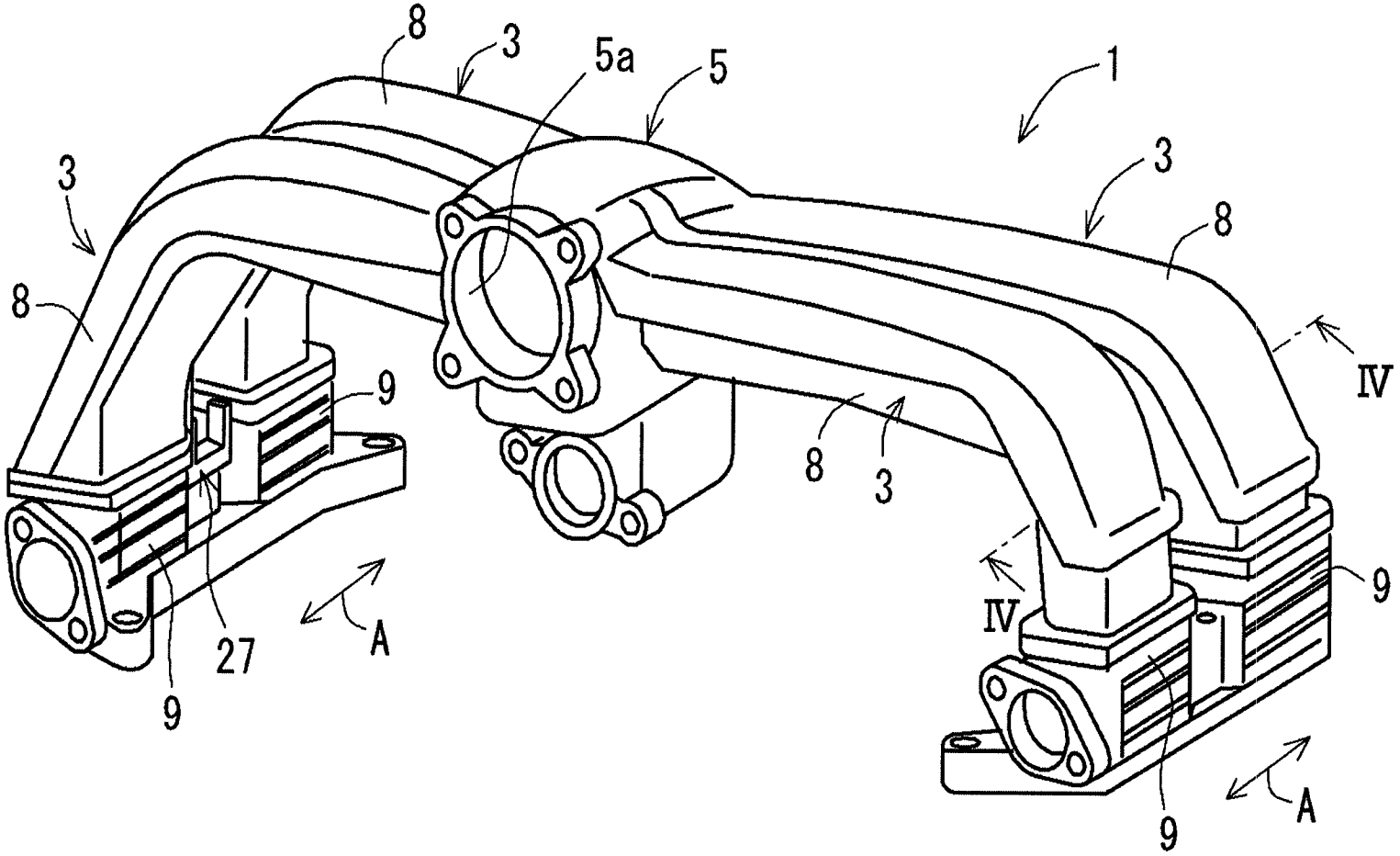
FIG. 1 is a perspective view showing an intake manifold in accordance with an example.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

In accordance with the present embodiment, an intake manifold (1) includes a plurality of intake pipes (3) which are provided in line so as to send air to an engine (2) mounted on a vehicle (6) through the intake pipes. Each of the intake pipes is provided with a main body (8) formed of resin and an end pipe (9) formed of resin, welded to a lower stream end side of the main body, and joined to the engine (refer to, for example, FIGS. 1 to 4). One member of the main body (8) and the end pipe (9) is provided with a rib (27, 31, 32, 33) which is formed on a side surface portion of the one member and which extends toward a lateral side of the other member. The other member is provided with a restriction portion (10) which is formed on a side surface portion of the other member and which interferes with the rib (27, 31, 32, 33) to restrict moving of the main body in a crash direction relative to the end pipe when a weld portion (wp) of the main body (8) and the end pipe (9) is broken due to a collision load (P) applied to each of the intake pipes (3) at a vehicle crash (refer to, for example, FIGS. 4 and 7A to 9B).

Incidentally, the shapes, numbers, arrangement locations, and the like of the rib and the restriction portion are not particularly limited, and are appropriately selected in accordance with the shapes of the engine and the intake pipe. Further, the crash direction is not particularly limited and is set arbitrarily. As the crash direction, for example, a longitudinal direction of the vehicle or a cross direction to the longitudinal direction of the vehicle (for example, a lateral direction of the vehicle) is suggested.

As the intake manifold of this embodiment, for example, it is suggested that the one member is the main body (8) and the other member is the end pipe (9) (refer to, for example, FIGS. 7A, 7B, 9A, and 9B).

According to the embodiment described above, it is suggested that each of the ribs (27) contains a pair of vertical ribs (27*a*) each of which extends from a side surface portion of a lower stream end side of each of the main bodies (8) of a pair of the intake pipes (3) which are adjacent to each other toward a lateral side of the end pipe (9) and a connection rib (27*b*) which connects the pair of vertical ribs. The vertical rib (27*a*) is arranged to be opposite to or in contact with the restriction portion (10) in the crash direction (refer to, for example, FIG. 4).

Figure 4:
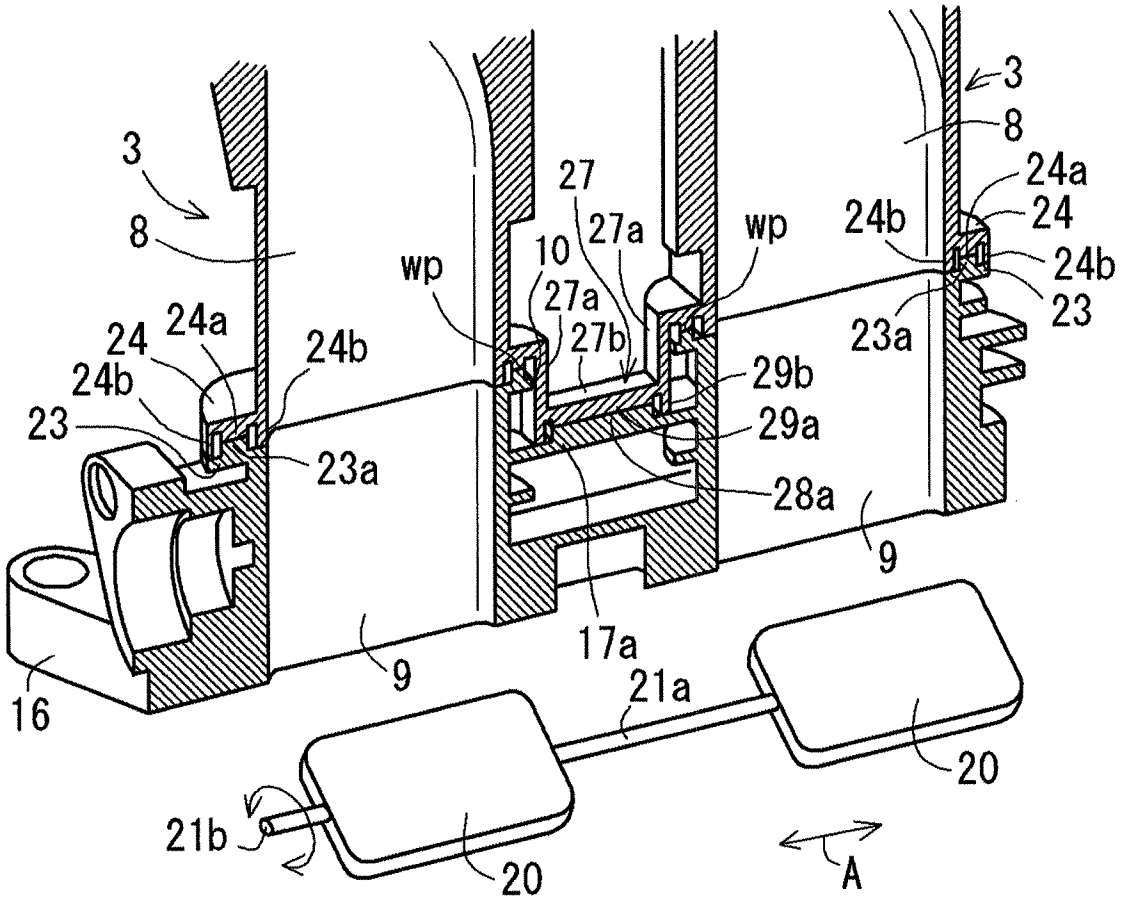
FIG. 4 is an enlarged sectional view taken along line IV-IV in FIG. 1.

According to the embodiment described above, for example, the connection rib (27*b*) is welded to a side of the end pipe (9) (refer to, for example, FIG. 4). In this case, it is preferable that the connection rib (27*b*) is welded on a reinforcement rib (17*a*) which is formed along a side surface portion of a pair of the end pipes (9) which are adjacent to each other from a point of view of strength of the intake pipe.

As the intake manifold of this embodiment, for example, it is suggested that each of the end pipes (9) includes a control valve (20) for controlling a volume of air flow (refer to, for example, FIG. 4).

Figure 6:
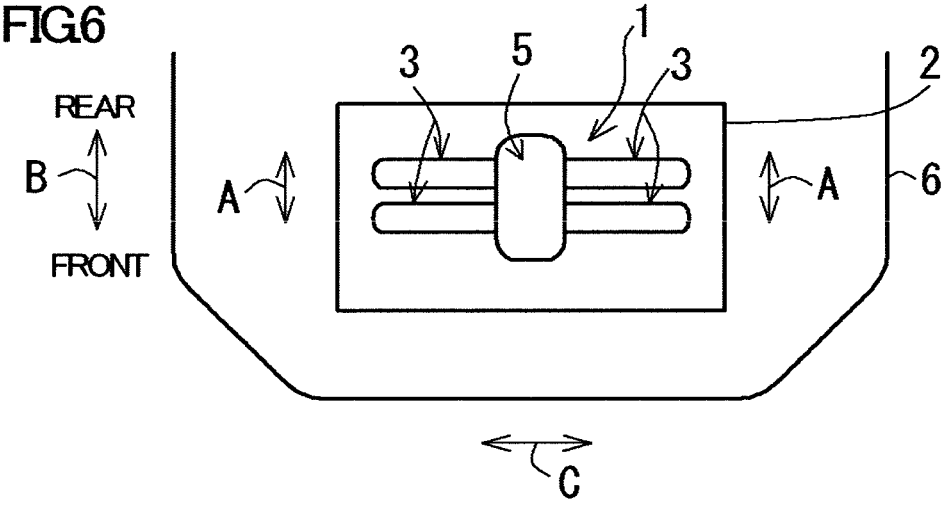
FIG. 6 is a plan view of a principal part of a vehicle on which an engine including the intake manifold is mounted.

As the intake manifold of this embodiment, for example, it is suggested that an alignment direction (A) of the intake pipes corresponds to the longitudinal direction (B) of the vehicle (refer to, for example, FIG. 6).

Reference signs in parentheses of components described in the above embodiment each indicate a correspondence with a concrete composition mentioned in examples which will be described later.

EXAMPLES

With reference to the drawings, a concrete description of the present invention will be made hereinafter by way of examples. Incidentally, in these examples, as an "intake manifold" of the present invention, the intake manifold 1 which is used for a horizontally opposed engine (concretely a horizontally opposed four-cylinder engine) 2 will be exemplified (refer to FIG. 6).

(1) Structure of Intake Manifold

As shown in FIG. 1, the intake manifold 1 according to this example includes the plurality of intake pipes 3 which are provided in line to send air to the engine 2 mounted on the vehicle 6 through the intake pipes 3 (refer to FIG. 6). A surge tank 5 on which an air inlet 5*a* is formed is provided on a central side of the intake manifold 1.

The intake pipes 3 extend downward from right and left sides of the surge tank 5 so as to be curved. Concretely, the pair of intake pipes 3 are provided on each of the right and left sides so as to correspond to a pair of combustion chambers (not shown) which are respectively disposed on the right and left sides of the engine 2. The alignment direction A of the pair of intake pipes 3 which are provided on each of the right and left sides corresponds to the longitudinal direction B of the vehicle (refer to FIG. 6). That is, in a state in which the vehicle 6 is equipped with the engine 2 on which the intake manifold 1 is mounted, the alignment direction A of the intake pipes 3 corresponds to the longitudinal direction B of the vehicle. Air introduced into the surge tank 5 is supplied to the combustion chambers of the engine 2 through each of the intake pipes 3.

Figure 2:
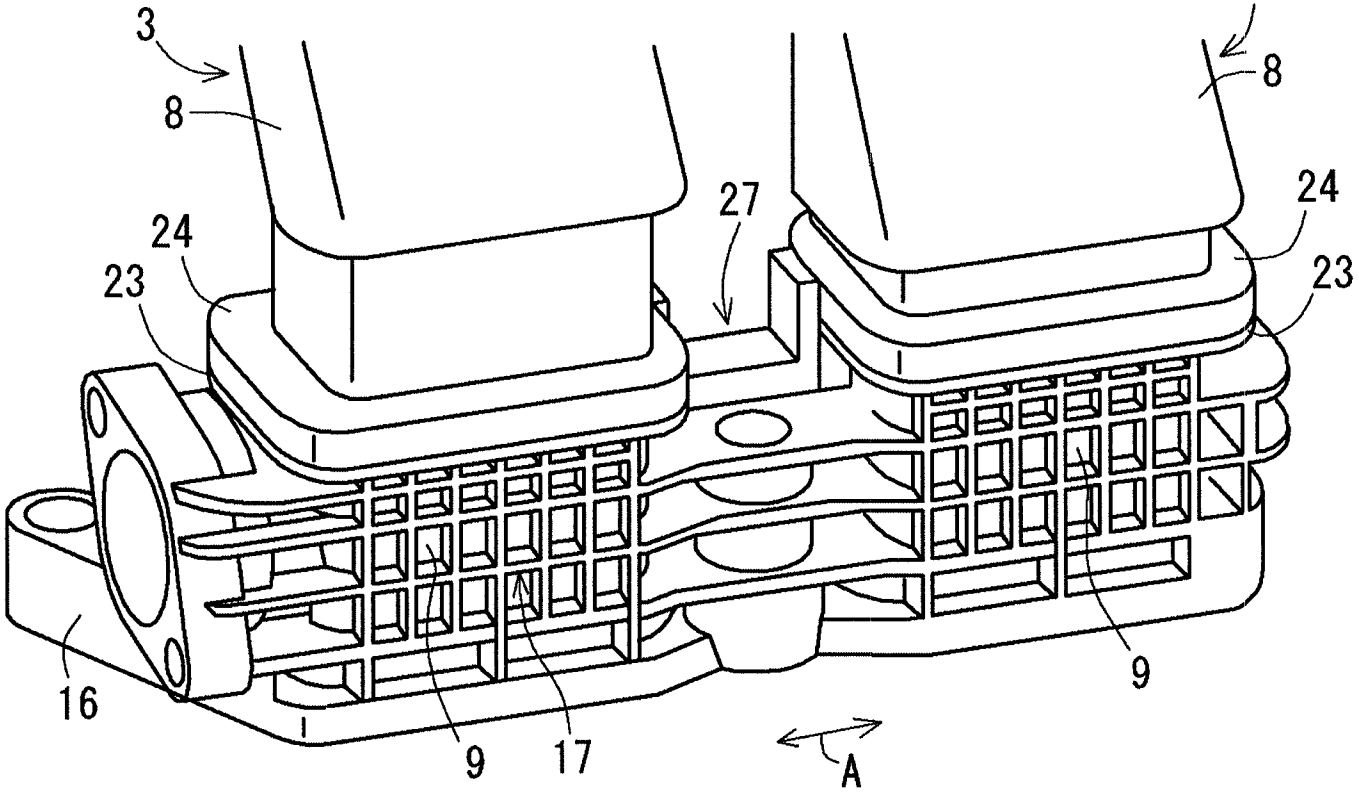
FIG. 2 is an enlarged view of a principal part of FIG. 1 and shows a weld state of a main body and an end pipe.
Figure 3:
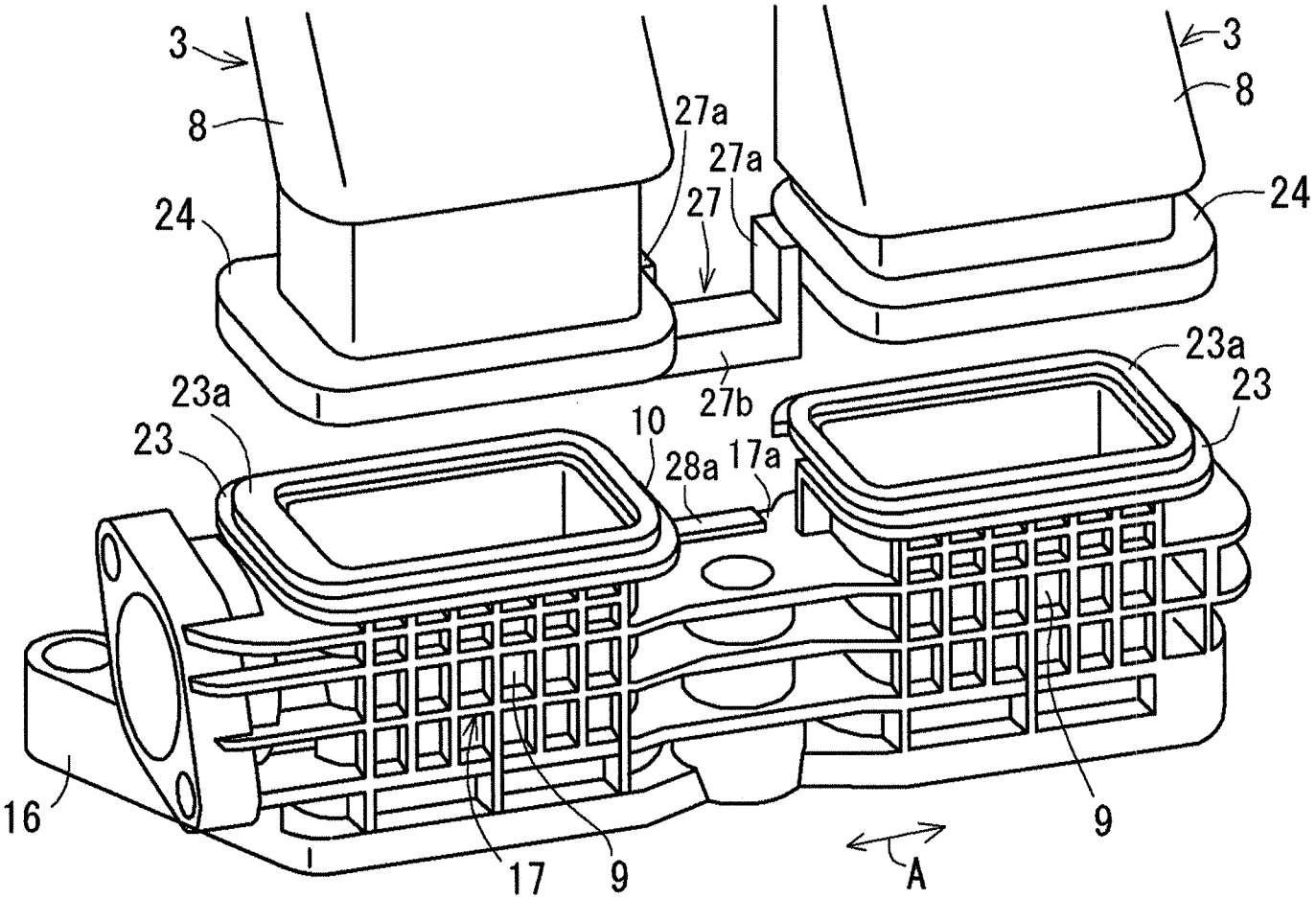
FIG. 3 is an enlarged view of the principal part of FIG. 1 and shows an exploded state of the main body and the end pipe.

Each of the intake pipes 3 is provided with the main body 8 and the end pipe 9 which is welded to the lower stream end side of the main body 8 (that is, the lower stream end side of air stream of the main body 8) and which is joined to the engine 2 as shown in FIGS. 2 to 4. Each of the main body 8 and the end pipe 9 is formed of synthetic resin of heat resistance, such as, polyamide resin. Incidentally, the main body 8 of each intake pipe 3 and the surge tank 5 are structured by welding a lower member 11 whose upper surface side is open and an upper member 12 whose lower surface side is open to close an opening of the upper surface side of the lower member 11 to each other by vibration welding (refer to FIGS. 5A and 5B).

Figure 7A:
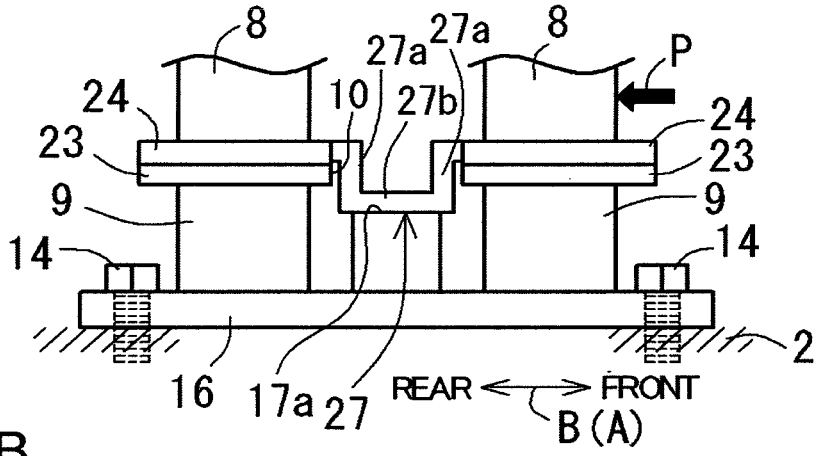
FIG. 7A is a diagram to explain operation of the intake manifold in a state of a vehicle crash.
Figure 7B:
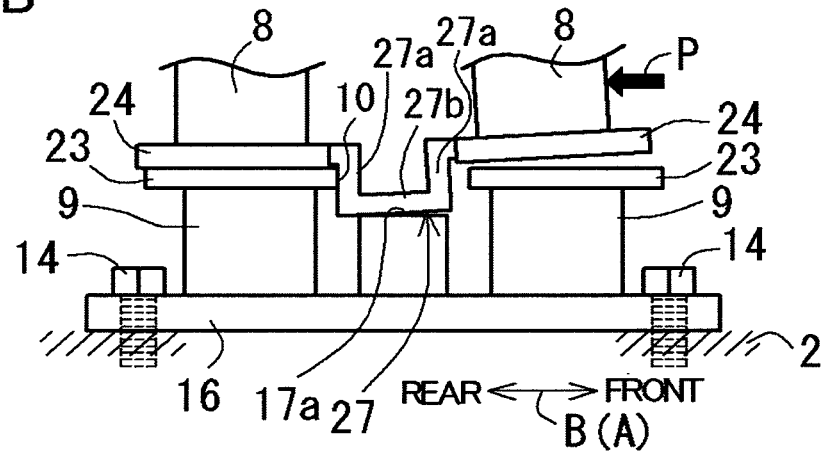
FIG. 7B is a diagram to explain the operation of the intake manifold in a state just after the vehicle crash.

A plurality of the end pipes 9 (two end pipes 9 are shown in the drawings) are integrally formed on a base 16 which is joined to the engine 2 with a plurality of bolts 14 so that the end pipes are adjacent to each other (refer to FIGS. 7A and 7B). A reinforcement rib 17 which shows a gridded shape is formed on the side surface portions of the end pipes 9. The connection rib 27*b* of the rib 27 which will be described later is welded on a reinforcement rib 17*a* which composes the reinforcement rib 17 and which is formed to extend in a lateral direction across the pair of end pipes 9 which are adjacent each other (refer to FIGS. 3 and 4).

Figure 5A:
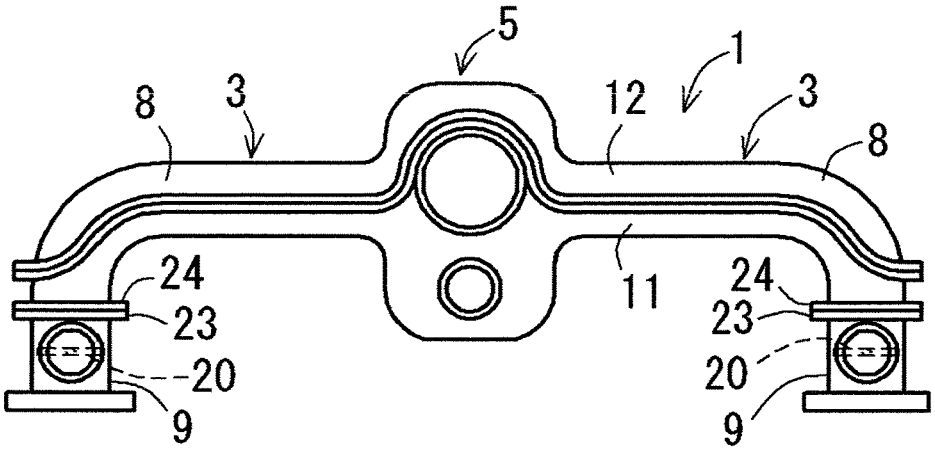
FIG. 5A is a front view showing an assembled state of the intake manifold.
Figure 5B:
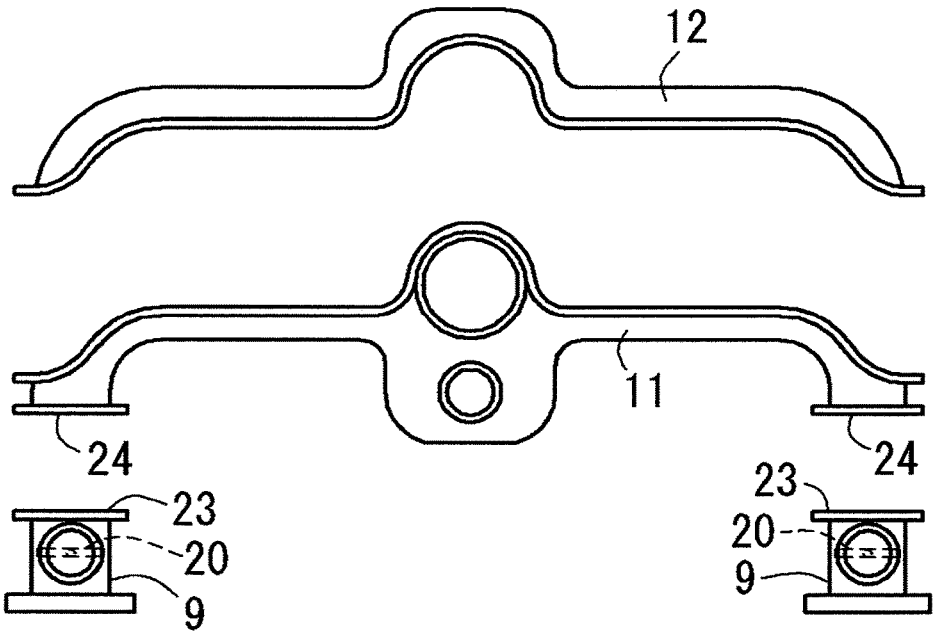
FIG. 5B is a front view showing an exploded state of the intake manifold.

A control valve 20 for controlling a volume of air flow is provided in each of the pair of end pipes 9 as shown in FIGS. 4, 5A, and 5B. The control valves 20 are connected each other with a connection shaft 21*a*, and a drive shaft 21*b* provided on one of the control valves 20 is driven by an actuator (not shown) to adjust a space area in the end pipe 9. Concretely, each of the control valves 20 controls the space area in the end pipe 9 in accordance with a load situation of the engine 2 so as to generate tumble flow in a cylinder of the engine 2.

As shown in FIG. 4, a flange 23 on which a projection stripe 23*a* is formed to serve as a welding margin is provided on one end side (that is, an upper end side) of each of the end pipes 9. Further, a flange 24 on which a projection stripe 24*a* is formed to be joined to the projection stripe 23*a* and to serve as a welding margin is provided on a lower end side of each of the main bodies 8. Ribs 24*b* are formed on the flange 24 so that each of the ribs 24*b* is positioned at an inner circumference side or an outer circumference side with a gap with respect to the projection stripe 24*a*. Both the flanges 23, 24 are fixed to each other by receiving relative displacement with vibration between the main body 8 and the end pipe 9 so as to melt the projection stripes 23*a*, 24*a* in a state in which the projection stripes 23*a*, 24*a* of both the flanges 23, 24 are in contact with each other.

The rib 27 is integrally formed on the side surface portion of the lower stream end side of each of the main bodies 8 so as to extend toward the lateral side of the end pipe 9 as shown in FIGS. 3 and 4. Further, the end pipe 9 is provided with a restriction portion 10 which is integrally formed on the side surface portion of the end pipe 9 and which interferes with the rib 27 to restrict moving of the main body 8 in the crash direction (concretely, the longitudinal direction B of the vehicle) relative to the end pipe 9 when the weld portion wp of the main body 8 and the end pipe 9 is broken due to the collision load P applied to the intake pipe 3 at the vehicle crash. The restriction portion 10 is formed of a part of the flange 23.

Each of the ribs 27 contains the pair of vertical ribs 27*a*, 27*a* each of which extends from the side surface portion of each of the main bodies 8 of the pair of intake pipes 3 toward the lateral side of the end pipe 9 and the connection rib 27*b* which connects lower end sides of the pair of vertical ribs 27*a*, 27*a* to each other. The vertical rib 27*a* is disposed to be opposite to the restriction portion 10 of the end pipe 9 in the longitudinal direction B of the vehicle.

An upper end side of each of the vertical ribs 27*a* is connected to the flange 24 of the main body 8. Further, the connection rib 27*b* is welded on the reinforcement rib 17*a* which is provided on the end pipes 9. A protrusion 28*a* which serves as a welding margin is formed on an upper surface side of the reinforcement rib 17*a*. A protrusion 29*a* which serves as a welding margin to be joined to the protrusion 28*a* is formed on a lower surface side of the connection rib 27*b*. Furthermore, a rib 29*b* is formed on the lower surface side of the connection rib 27*b* so that the rib 29*b* is positioned at an outer peripheral side with a gap with respect to the protrusion 29*a*. The connection rib 27*b* and the reinforcement rib 17*a* are fixed to each other by receiving relative displacement with vibration between the main body 8 and the end pipe 9 so as to melt the protrusions 28*a*, 29*a* in a state in which the protrusions 28*a*, 29*a* of the connection rib 27*b* and the reinforcement rib 17*a* are in contact with each other.

(2) Operation of Intake Manifold

An operation of the intake manifold 1 of the above structure will be described hereinafter. The weld portion wp of the main body 8 and the end pipe 9 is sometimes broken and separated (refer to FIG. 7B) due to the collision load P applied to the intake pipe 3 at the vehicle crash from the front side (refer to FIG. 7A). At this moment, the vertical rib 27*a* and the restriction portion 10 interfere with each other (that is, the restriction portion 10 catches the vertical rib 27*a*) to restrict moving of the main body 8 in the crash direction (concretely, the longitudinal direction B of the vehicle) relative to the end pipe 9 which is joined to the engine 2. Therefore, the weld fracture surface of the main body 8 and the end pipe 9 is hard to be exposed to restrain harm which the weld fracture surface applies to peripheral parts (for example, a fuel hose).

(3) Effects in this Example

According to the intake manifold 1 of this example, each of the intake pipes 3 includes the main body 8 formed of resin and the end pipe 9 formed of resin, welded to the lower stream end side of the main body 8, and joined to the engine 2. The main body 8 is provided with the rib 27 which is formed on the side surface portion of the lower stream end side of the main body 8 and which extends toward the lateral side of the end pipe 9. The end pipe 9 is provided with the restriction portion 10 which is formed on the side surface portion of the end pipe 9 and which interferes with the rib 27 to restrict moving of the main body 8 in the crash direction relative to the end pipe 9 when the weld portion wp of the main body 8 and the end pipe 9 is broken due to the collision load P applied to the intake pipe 3 at the vehicle crash. Therefore, since the rib 27 and the restriction portion 10 interfere with each other at the vehicle crash, the main body 8 is restricted from moving in the crash direction relative to the end pipe 9 which is joined to the engine 2. Hence, the weld fracture surface of the main body 8 is hard to be exposed to restrain harm which the weld fracture surface applies to the peripheral parts. Further, the intake manifold has a structure which is more lightweight and inexpensive than that of the conventional intake manifold including a metal holder.

According to this example, each of the ribs 27 contains the pair of vertical ribs 27*a* and the connection rib 27*b*. The vertical rib 27*a* is arranged to be opposite to the restriction portion 10 in the crash direction. Hence, since the vertical rib 27*a* and the restriction portion 10 interfere with each other, the main body 8 is restricted from moving in the crash direction relative to the end pipe 9. Because the rib 27 is provided to be put across each of the main bodies 8 of the pair of intake pipes 3 which are adjacent to each other, the strength of the pair of intake pipes 3 is increased.

According to this example, the connection rib 27*b* is welded to the side of the end pipe 9. Therefore, weld strength of the main body 8 and the end pipe 9 is increased. According to this example, particularly, the connection rib 27*b* is welded on the reinforcement rib 17*a* which is formed across the side surface portion of the pair of end pipes 9 which are adjacent each other. Hence, the strength of the pair of intake pipes 3 is further increased.

According to this example, each of the end pipes 9 includes the control valve 20 for controlling the volume of air flow. Therefore, installation accuracy of the control valve 20 is increased.

According to this example, the alignment direction A of the intake pipes 3 corresponds to the longitudinal direction B of the vehicle. Therefore, the main body 8 is restricted from moving in the crash direction (that is, the longitudinal direction B of the vehicle) relative to the end pipe 9 at the vehicle crash from the front side.

Figure 8A:
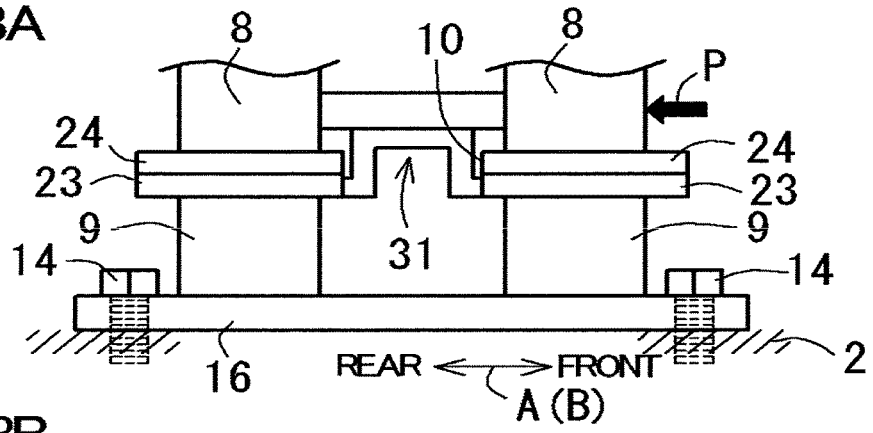
FIG. 8A is a diagram to explain an intake manifold of another embodiment in the state of the vehicle crash.
Figure 8B:
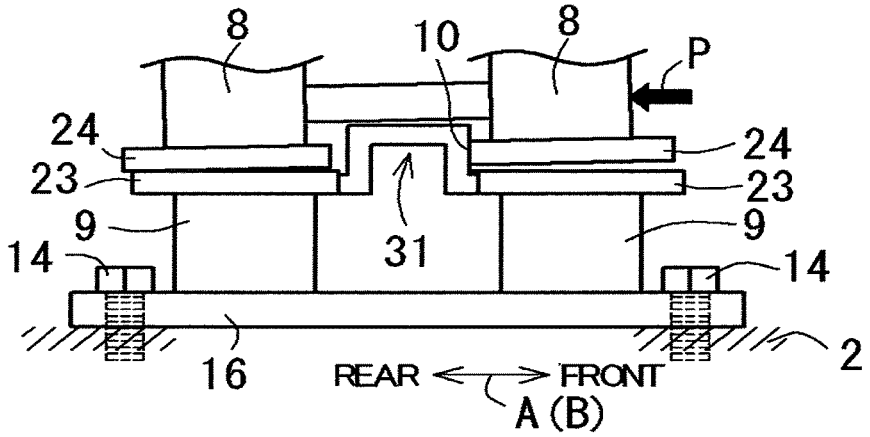
FIG. 8B is a diagram to explain the intake manifold of another embodiment in the state just after the vehicle crash.
Figure 9A:
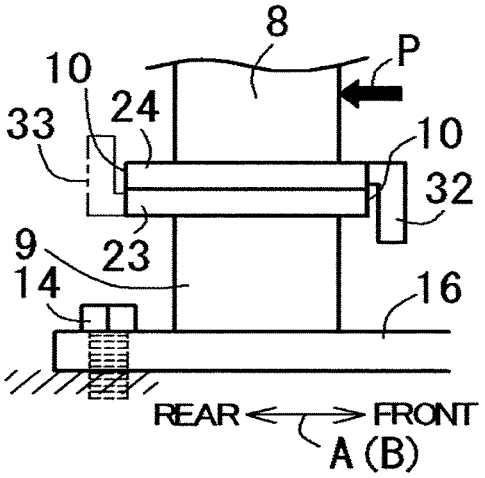
FIG. 9A is a diagram to explain an intake manifold of still another embodiment in the state of the vehicle crash.
Figure 9B:
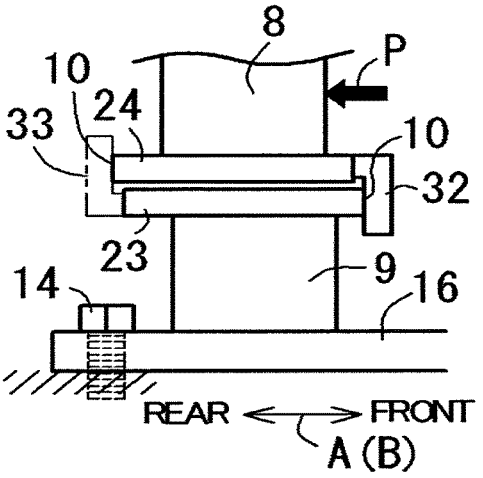
FIG. 9B is a diagram to explain the intake manifold of still another embodiment in the state just after the vehicle crash.

As many apparently widely different examples of this invention may be made without departing from the spirit and scope thereof, it is to be understood that the invention is not limited to the specific examples thereof except as defined in the appended claims. That is, according to this example, each of the ribs 27 is provided to be put across the pair of main bodies 8 which are adjacent to each other. However, it is to be understood that the present invention is not intended to be limited to this example. For example, a rib 31 may be provided to be put across the pair of end pipes 9 which are adjacent to each other as shown in FIGS. 8A and 8B. Further, for example, a rib 32 or a rib 33 may be provided to be integrally formed on the single main body 8 or the single end pipe 9 as shown in FIGS. 9A and 9B.

According to the example described above, the rib 27 is opposite to the restriction portion 10 in the state in which the main body 8 and the end pipe 9 are welded to each other. However, it is to be understood that the present invention is not intended to be limited to this example. For example, the rib 27 may be in contact with the restriction portion 10 in a state in which the main body 8 and the end pipe 9 are welded to each other.

According to the example described above, the rib 27 is welded to the end pipes 9. However, it is to be understood that the present invention is not intended to be limited to this example. For example, the rib 27 may not be welded to the end pipe 9.

According to the example described above, the restriction portion 10 is formed with a part of the flange 23 of the end pipe 9. However, it is to be understood that the present invention is not intended to be limited to this example. For example, the restriction portion 10 may be provided on a portion of the end pipe 9 except the flange 23.

According to the example described above, each of the end pipes 9 includes the control valve 20. However, it is to be understood that the present invention is not intended to be limited to this example. For example, the end pipe 9 may not include the control valve 20. Further, each of the end pipes 9 may include another functional component instead of or in addition to the control valve 20.

According to the example described above, the main body 8 and the end pipe 9 are fixed to each other by vibration welding. However, it is to be understood that the present invention is not intended to be limited to this example. For example, the main body 8 and the end pipe 9 may be fixed to each other by, for example, laser welding, ultrasonic welding, thermal welding, or induced welding.

According to the example described above, the structure including the horizontally opposed engine 2 as the engine is described. However, it is to be understood that the present invention is not intended to be limited to this example. For example, an inline engine or a V-type engine may be applied to the example. Further, according to the example described above, the structure including the front engine is described. However, it is to be understood that the present invention is not intended to be limited to this example. For example, a rear engine or a mid-ship engine may be applied to the example.

According to the example described above, the intake manifold 1 includes the pair of intake pipes 3 which are provided in line. However, it is to be understood that the present invention is not intended to be limited to this example. For example, the intake manifold 1 may include three or more intake pipes 3 which are provided in line. Incidentally, the shape, the number, and the like of the intake pipe are appropriately selected in accordance with the form of the engine.

According to the example described above, the rib 27 and the restriction portion 10 restrict moving of the main body 8 in the crash direction (the longitudinal direction B of the vehicle) relative to the end pipe 9 at the vehicle crash from the front side. However, it is to be understood that the present invention is not intended to be limited to this example. For example, the rib and the restriction portion may restrict moving of the main body 8 in the crash direction (a direction crossing the longitudinal direction B of the vehicle) relative to the end pipe 9 at the vehicle crash from the lateral side instead of or in addition to at the vehicle crash from the front side.

According to the example described above, the intake manifold 1 includes the intake pipes whose alignment direction A corresponds the longitudinal direction B of the vehicle. However, it is to be understood that the present invention is not intended to be limited to this example. For example, the intake manifold may include the intake pipes whose alignment direction A corresponds a direction crossing the longitudinal direction B of the vehicle (for example, a lateral direction of the vehicle).

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above-described embodiments, and various variations and modifications may be possible without departing from the scope of the present invention.

The present invention is widely used as a technology relating to an intake manifold sending air to an engine which is used in a vehicle such as a passenger car, a bus, or a truck.

What is claimed is:

1. An intake manifold comprising a plurality of intake pipes that are provided in line to send air to an engine mounted on a vehicle through the intake pipes, each of the intake pipes including:

a main body formed of resin; and an end pipe formed of resin, welded to a lower stream end side of the main body, and configured to be joined to the engine, wherein one member of the main body and the end pipe is provided with a rib that is formed on a side surface portion of the one member and that extends toward a lateral side of the other member, and the other member is provided with a restriction portion that is formed on a side surface portion of the other member and that interferes with the rib to restrict moving of the main body in a crash direction relative to the end pipe when a weld portion of the main body and the end pipe is broken due to a collision load applied to each intake pipe at a vehicle crash.

2. The intake manifold according to claim 1, wherein the one member is the main body, and the other member is the end pipe.

3. The intake manifold according to claim 2, wherein the rib contains:

a pair of vertical ribs each of which extends from the side surface portion of the lower stream end side of each of the main bodies of a pair of the intake pipes that are adjacent to each other toward the lateral side of the end pipe; and a connection rib that connects the pair of vertical ribs to each other, and least one of the pair of vertical ribs is arranged to be opposite to or in contact with the restriction portion in the crash direction.

4. The intake manifold according to claim 3, wherein the connection rib is welded to a side of the end pipe.

5. The intake manifold according to claim 1, wherein the end pipe includes a control valve configured to control a volume of air flow.

6. The intake manifold according to claim 1, wherein an alignment direction of the intake pipes corresponds to a longitudinal direction of the vehicle.

7. The intake manifold according to claim 1, wherein flanges are provided on an axial end side of the main body and an axial end side of the end pipe so as to be welded to each other, the rib is integrally formed on a side surface portion of the flange of the one member, and the restriction portion is integrally formed on a side surface portion of the flange of the other member.

* * * * *